US009968127B2

(12) United States Patent
Han

(10) Patent No.: US 9,968,127 B2
(45) Date of Patent: May 15, 2018

(54) SMOKING DEVICE

(71) Applicant: Jeffrey Han, Los Altos Hills, CA (US)

(72) Inventor: Jeffrey Han, Los Altos Hills, CA (US)

(73) Assignee: Tyger Manufacturing LLC, Walnut, CA (US)

( * ) Notice: Subject to any disclaimer, the term of this patent is extended or adjusted under 35 U.S.C. 154(b) by 324 days.

(21) Appl. No.: 14/625,013

(22) Filed: Feb. 18, 2015

(65) Prior Publication Data

US 2016/0235115 A1 Aug. 18, 2016

(51) Int. Cl.
*A24F 1/28* (2006.01)
*A24F 1/32* (2006.01)
*A24F 7/00* (2006.01)

(52) U.S. Cl.
CPC ..... *A24F 1/28* (2013.01); *A24F 1/32* (2013.01); *A24F 7/00* (2013.01)

(58) Field of Classification Search
CPC ..... A24F 47/008; A24F 47/00; A24F 1/28; A24F 1/32; A24F 7/00; A24F 7/02; A24F 13/10; A24F 13/16; A24F 13/20; A24F 1/26
See application file for complete search history.

(56) References Cited

U.S. PATENT DOCUMENTS 136,487 A * 3/1873 Buynitzky ..... A24F 1/00 131/180
2,402,914 A * 6/1946 Robertson ..... A24F 1/26 131/180
4,286,416 A * 9/1981 Cooper, Jr. ..... B28D 1/181 15/104.095
5,687,746 A * 11/1997 Rose ..... A24F 47/002 128/202.21
2005/0016553 A1* 1/2005 Iannuzzi ..... A24F 47/002 131/273
2007/0267032 A1* 11/2007 Shan ..... A24F 47/002 131/275
2010/0078035 A1* 4/2010 Erickson ..... A24F 1/28 131/191

(Continued)

OTHER PUBLICATIONS

All Products. Fastening Solutions—Driv Lok. Wayback Machine Generated, Jun. 4, 2012. Web. Apr. 14, 2017.*

(Continued)

*Primary Examiner* — Seyed Masoud Malekzadeh
*Assistant Examiner* — Taryn Trace Willett

(57) ABSTRACT

The present invention is a smoking device comprising a glass housing having lower and upper open end portions and an inner portion. The smoking device further comprises a mouthpiece rotatably engaged with the lower open end portion of the housing. The mouthpiece comprises a front surface, a rear surface, and a plurality of air passage ways extending from the front surface to the rear surface and in communication with the inner portion of the housing. The smoking device further comprises an auger comprising a first end portion engaged with the mouthpiece and a second end portion extending within the inner portion of the housing. Rotation of the mouthpiece causes the auger to rotate and the smoking material to be moved upward thru the inner portion of the housing where it is ignited by a match, lighter or other heat source.

8 Claims, 5 Drawing Sheets

(56) References Cited

U.S. PATENT DOCUMENTS

| | | | | |
|---|---|---|---|---|
| 2015/0020822 | A1* | 1/2015 | Janardhan | A24F 47/008 131/328 |
| 2015/0122277 | A1* | 5/2015 | Frobisher | A24D 3/04 131/329 |
| 2015/0136124 | A1* | 5/2015 | Aronie | A24F 47/008 128/202.21 |
| 2015/0144146 | A1* | 5/2015 | Selby | A24F 1/28 131/328 |
| 2015/0223523 | A1* | 8/2015 | McCullough | A61M 15/06 131/328 |
| 2016/0198769 | A1* | 7/2016 | Liu | F22B 1/284 131/329 |
| 2017/0035105 | A1* | 2/2017 | Jordan | A24F 9/16 |

OTHER PUBLICATIONS

"The FourHitter Story . . . " The Indestructible Smoking Device That Is the Best Way to Smoke. Wayback Machine Generated, Jan. 2, 2014. Web. Apr. 14, 2017.*

LightEnergyGlass. "Glass Blunt—CraftStylish." CraftStylish.com. N.p., Jun. 6, 2011. Web. Apr. 14, 2017.*

"Right and Left Hand Screws." Right and Left Hand Screws. Henan Pingyuan Mining Machinery Co., Ltd., Aug. 16, 2014. Web. Apr. 14, 2017.*

"Twisty Glass Blunt: Christmas Presale." 7pipe. Wayback Machine Generated, Nov. 29, 2014. Web.*

USA, Component Force. "Silicone Rubber Caps." Silicone Rubber Caps, Caps Silicone, End Caps. Wayback Machine Generated, Sep. 20, 2012. Web. Apr. 14, 2017.*

* cited by examiner

SMOKING DEVICE

BACKGROUND OF THE INVENTION

The present invention relates to smoking devices such as pipes used by a person to smoke or consume a smoking material such as tobacco, medical marijuana, or the like. Various conventional smoking devices have been designed, but all conventional smoking devices must deal with the problem of removing waste product from the smoking device, such as ash and resin, which are the natural results of igniting, burning, combusting, or otherwise heating the smoking materials. Waste products not removed from the pipe can negatively impact the taste and enjoyment of any newly loaded or remaining smoking materials. As such, waste products must be removed from conventional smoking pipes before another load of smoking materials may be added to the pipe. In most traditional tobacco pipes, for example, the ash is simply dumped from by the chamber by turning the bowl upside. Cleaning tools such as a pick or reamer may be necessary to completely clear the ash and resin from the bowl and the stem of the pipe.

SUMMARY OF THE INVENTION

The present invention is a smoking device that may be used by a person to consume or smoke a smoking material such as tobacco, medical marijuana, or the like. The smoking device comprises a glass housing having lower and upper open end portions and an inner portion. The smoking device further comprises a mouthpiece rotatably engaged with the lower open end portion of the housing. The mouthpiece a front surface, a rear surface, and a plurality of air passage ways extending from the front surface to the rear surface and in communication with the inner portion of the housing. The smoking device further comprises an auger comprising a first end portion engaged with the mouthpiece and a second end portion extending within the inner portion of the housing. Rotation of the mouthpiece causes the auger to rotate and the smoking material to be moved downward or upward through the inner portion of the housing. Alternatively, smoking material can be moved downward or upward along the housing by holding the mouthpiece in place, and thereby holding the auger in place, while rotating the housing. A user of the present invention may also rotate both the housing and the mouthpiece in opposite directions to move the smoking materials within the housing. Smoking material located at the open end of the housing can be ignited by a match, lighter, or other heat source. As smoking material is consumed, waste product can be removed from the smoking device by rotating either the mouthpiece, the housing, or both to cause the waste product to be pushed out of the open end of the housing.

BRIEF DESCRIPTION OF THE DRAWINGS

The following description of the invention will be more fully understood with reference to the accompanying drawings in which.

DESCRIPTION OF THE INVENTION

Figure 1:
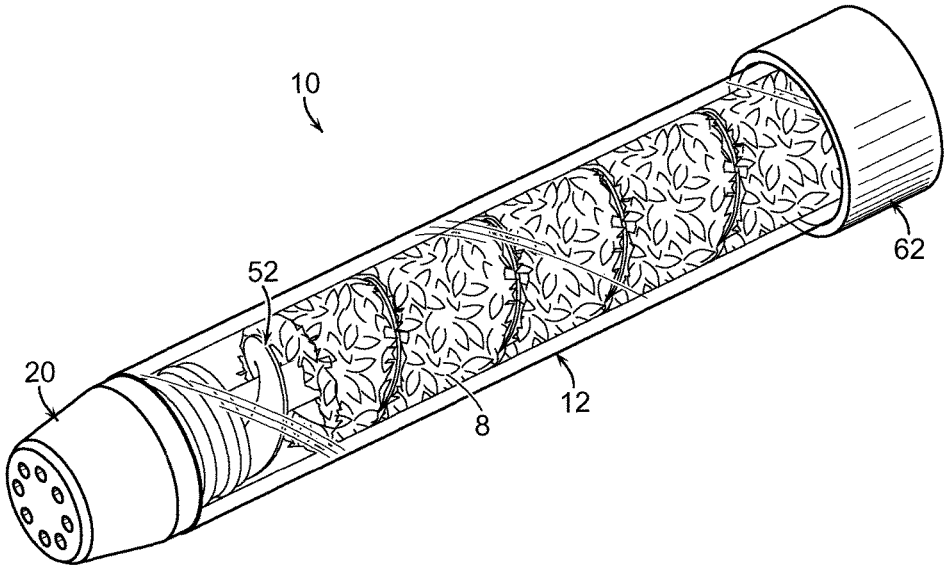
FIG. 1 is a front perspective view of a smoking device according the present invention.
Figures 2, 3:
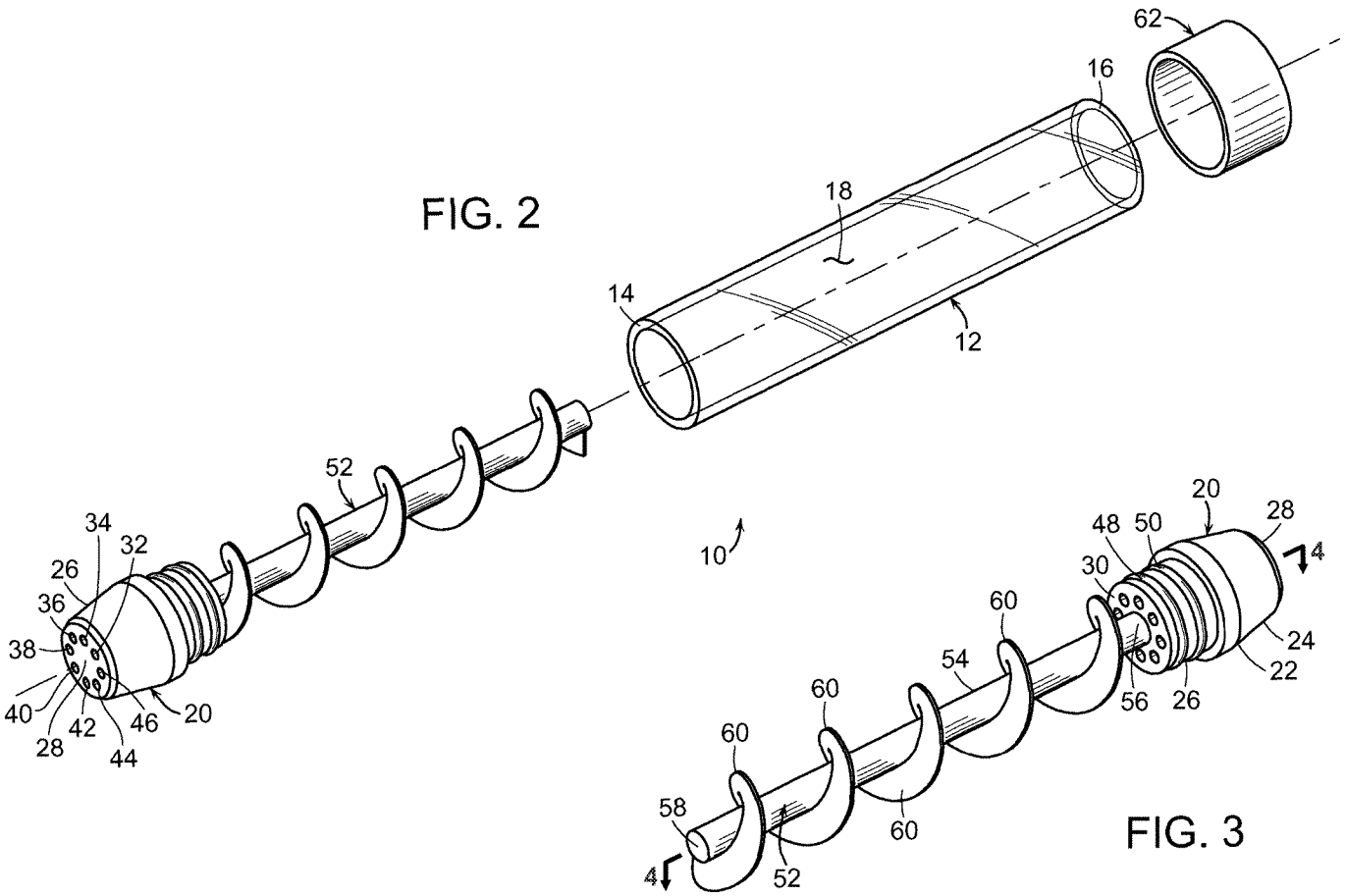
FIG. 2 is an exploded view of the smoking device.
FIG. 3 is rear perspective of a mouthpiece and auger according to the present invention.
Figure 4:
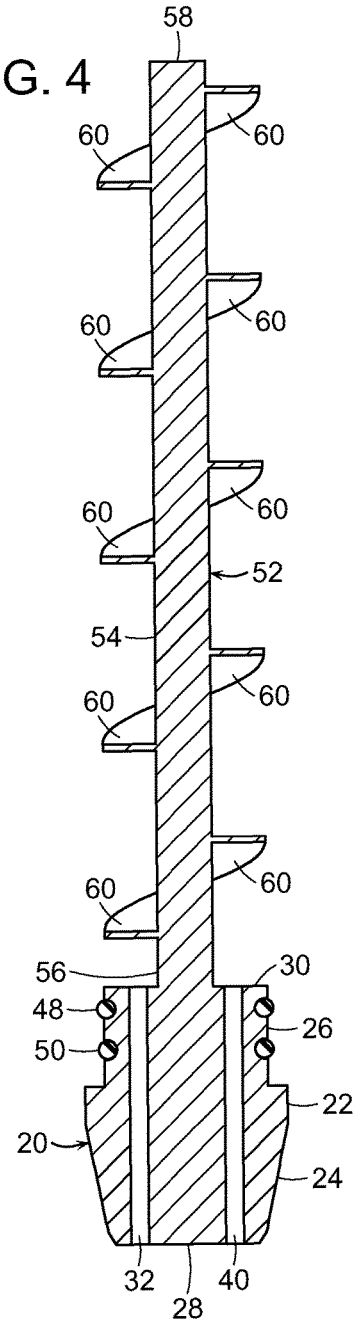
FIG. 4 is a cross-section view taken along line 3-3 of FIG. 3.

Referring to FIGS. 1 and 2, a smoking device 10 may be used by a person to smoke or consume a smoking material 8 such as tobacco, medical marijuana or the like. Smoking device 10 generally comprises a housing 12, a mouthpiece 20, and an auger 52 engaged with or formed as part of mouthpiece 20. As will be described more fully herein, rotation of mouthpiece 20 causes auger 52 to rotate and smoking material 8 to move upward within housing 12 where it is ignited by a match, lighter or other heat source. Smoking device 10 provides an easier and more effective way of consuming smoking material 8 than conventional smoking devices.

Referring to FIG. 2, housing 12 comprises a lower open end portion 14, an upper open end portion 16, and an inner portion 18. Housing 12 is a cylindrical tube having a length of about 86 mm, a wall thickness of about 2 mm, and a inside diameter of about 13 mm. Housing 12 is made from boro silicate glass or any other material having good heat resistant properties. Housing 12 is fabricated by conventional processes.

Referring to FIGS. 2 and 3, mouthpiece 20 comprises a body 22 having a front body portion 24, a rear body portion 26, a front surface 28, and a rear surface 30. Rear body portion 26 is rotatably disposed within lower open end portion 14 of housing 12. Rear body portion has a diameter of about 13 mm but should be slightly less than the inside diameter of lower open end portion 14 to permit rotation therein. Mouthpiece 20 further comprises an o-ring 48 engaged with and retained by an annular channel (not shown) formed in rear body portion 24 of body 22 to provide sealed engagement between rear body portion 24 of mouthpiece 20 and lower open end portion 14 of housing 12 during rotation of rear body portion 26 relative to lower open end portion 14 of housing 12. Mouthpiece 20 further comprises an o-ring 50 engaged with and retained by an annular channel (not shown) of rear body portion 24 to provide sealed engagement between rear body portion 24 of mouthpiece 20 and lower open end portion 14 of housing 12. O-ring 50 is provided in the event of failure of o-ring 48. The annular channels have a depth of about 1.78 mm. O-rings 48 and 50 are made from silicone rubber having an outside diameter of about 13 mm, and a thickness of about 1 mm. O-rings 48 and 50 are widely available. Different materials and hardness may be used so long as o-rings 48 and 50 allow and maintain rotatable sealed engagement between rear body portion 24 of mouthpiece 20 and lower open end portion 14 of housing 12. Mouthpiece 20 further comprises a plurality of air passage ways extending from front surface 28 to rear surface 30 and in communication with inner portion 18 of housing 12. Specifically, mouthpiece 20 comprises an air passage way 32 extending from front surface 28 to rear surface 30 and in communication with inner portion 18 of housing 12. Mouthpiece 20 further comprises an air passage way 34 extending from front surface 28 to rear surface 30 and in communication with inner portion 18 of housing 12. Mouthpiece 20 further comprises an air passage way 36 extending from front surface 28 to rear surface 30 and in communication with inner portion 18 of housing 12. Mouthpiece 20 further comprises an air passage way 38 extending from front surface 28 to rear surface 30 and in communication with inner portion 18 of housing 12. Mouthpiece 20 further comprises an air passage way 40 extending from front surface 28 to rear surface 30 and in communication with inner portion 18 of housing 12. Mouthpiece 20 further comprises an air passage way 42 extending from front surface 28 to rear surface 30 and in communication with inner portion 18 of housing 12. Mouthpiece 20 further comprises an air passage way 44 extending from front surface 28 to rear surface 30 and in communication with inner portion 18 of housing 12. Mouthpiece 20 further comprises an air passage way 46 extending from front surface 28 to rear surface 30 and in communication with inner portion 18 of housing 12. Air passage ways 32, 34, 36, 38, 40, 42, 44, and 46 are arranged in a circular pattern about front surface 28 and rear surface 30 of body 22. More or less than eight (8) air passage ways may be employed. Each of air passage ways 32, 34, 36, 38, 40, 42, 44, and 46 is shaped in the form of a cylinder having an inside diameter of about 1.5 mm. Any diameter significantly larger results in smoking material passing thru the air passage ways. Any diameter significantly smaller reduces air flow. Body 22 of mouthpiece 20 is made from brass or any other heat resistant material such as steel and fabricated by conventional processes.

With continued reference to FIG. 3, auger 52 comprises a shaft 54 having a first end portion 56 and a second end portion 58, and a helical blade 60. Auger 52 has a length of about 73 mm. Helical blade 54 has a diameter of about 13 mm and a pitch of about 17.3 mm. The diameter of helical blade 54 should be slightly less than the inside diameter of housing 12 to permit rotation therein. When fully assembled, second end portion 58 of auger 54 is disposed about 6 mm inward from upper open end portion 16 of housing 12 leaving a cherry or burn area within housing 12. Auger 52 is press-fitted or otherwise engaged or secured to rear body portion 26 of mouthpiece 20. Auger 52 is made from brass or any other heat resistant material such as steel and fabricated by conventional processes. Alternatively, mouthpiece 20 and 52 may be made from a single piece of material.

Smoking device 10 further comprises a cap 60 (FIG. 2) removably engaged with upper open end portion 16 of housing 12. Cap 60 is made from plastic and fabricated by conventional processes. Cap 60 is provided so that housing 12 can be filled with smoking material 8 and to prevent loss of smoking material 8 during non use and/or transport of smoking device 10 thereby making smoking device 10 easily portable. Cap 60 may be made from a variety of materials such as silicone rubber and fabricated by conventional processes.

Figure 5:
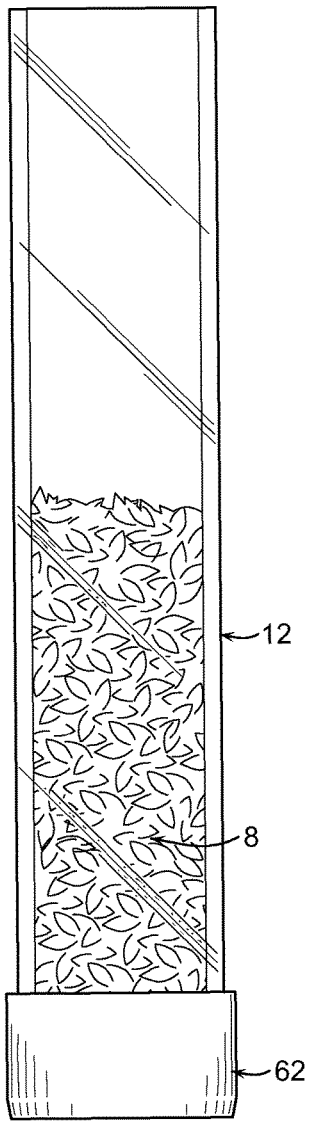
FIG. 5 is a view showing a housing of the smoking device filled with smoking material without insertion of the mouthpiece and auger.
Figure 6:
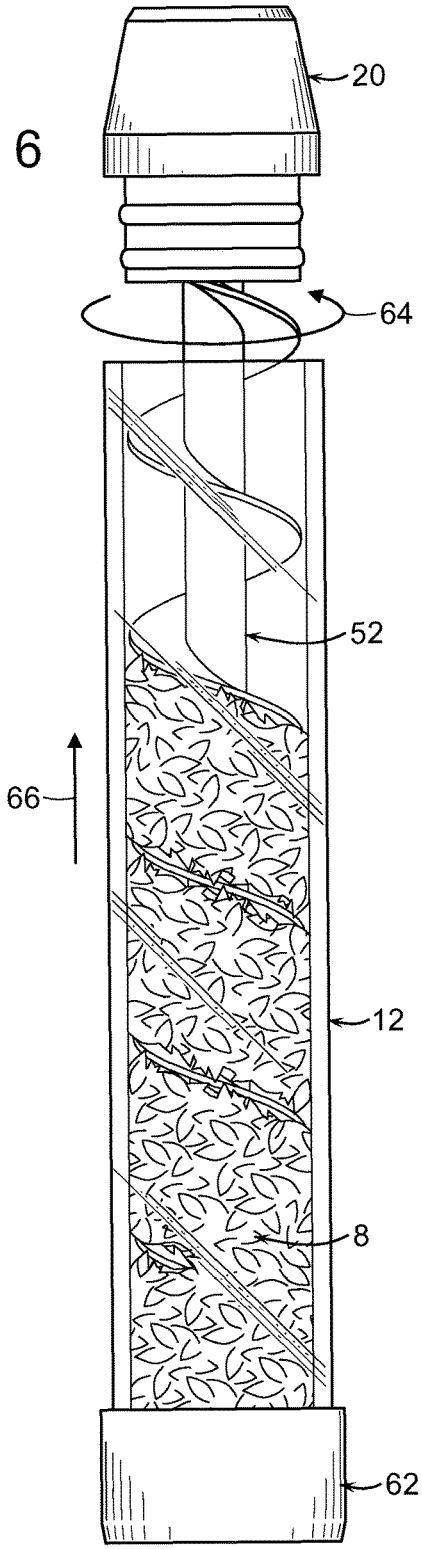
FIG. 6 is a view showing partial insertion of the mouthpiece and auger within the housing by counter clockwise rotation of the mouthpiece and auger causing movement of the smoking material around the helical blade of the auger.

Referring to FIGS. 5 and 6, where smoking device 10 is shown being filled with smoking material 8. As shown by FIG. 5, cap 60 is placed on upper open end portion 16 of housing 12. Housing 12 is flipped and disposed vertically so that cap 60 is resting upon a hard surface (not shown). Smoking material 8 is added thru lower open end portion 14 thereby filling upper open end portion 16 and inner portion 18. Housing 12 may be filled about half way with smoking material 8. As shown by FIG. 6, counter-clockwise rotation 64 of mouthpiece 20 causes helical blade 60 of auger 52 to rotate and move smoking material 8 from upper open end portion 16 toward lower open end portion 14 of housing 12 as helical blade 54 moves inward to inner portion 18 of housing 12. Continued counter-clockwise rotation 64 of mouthpiece 20 results in helical blade 60 being fully inserted within inner portion 18 of housing 12 with smoking material 8 surrounding most of helical blade 60 of auger 52. O-rings 48 and 50 provide sealed engagement.

Figure 7:
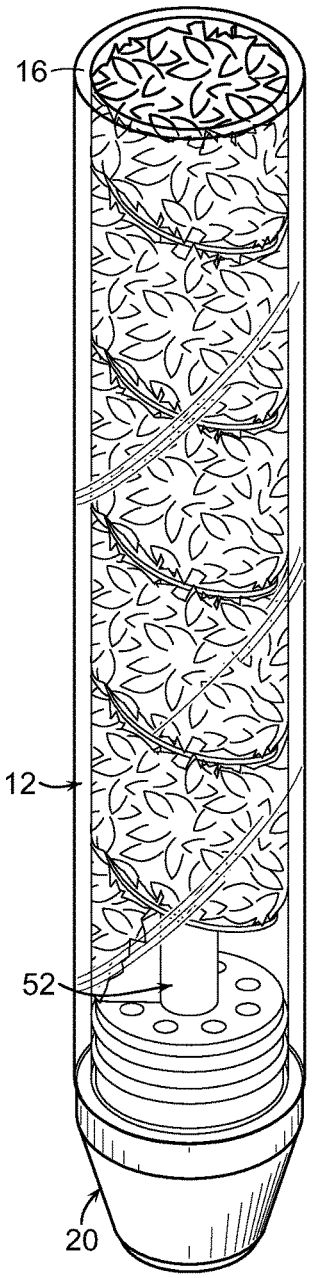
FIG. 7 is a perspective view of the smoking device filled with the smoking material and ready for use.

Referring to FIG. 7, where smoking device 10 is shown substantially filled with smoking material 8 with cap 60 removed.

Figure 8:
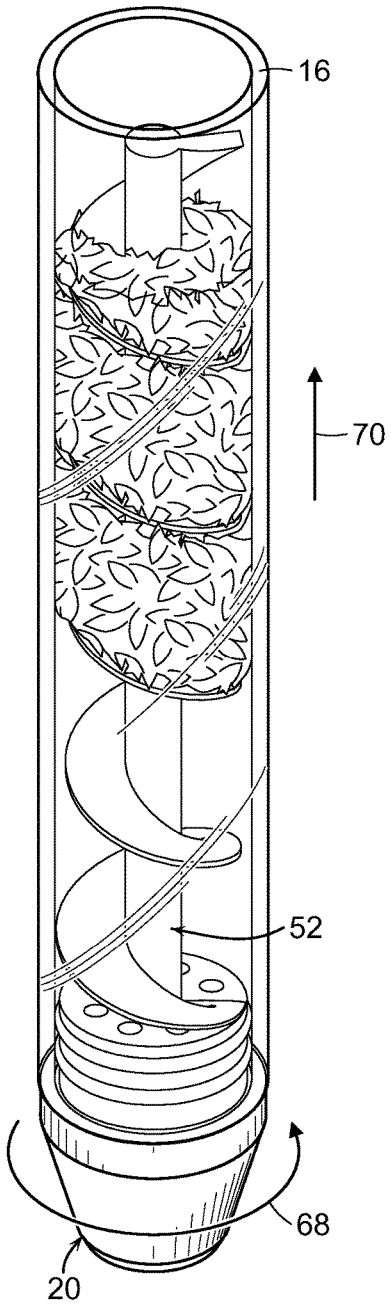
FIG. 8 is a perspective view of the smoking device after use and a number of clockwise rotations of the mouthpiece and auger leaving a small amount of smoking material remaining.

Referring to FIG. 8, where smoking device 10 is shown after use and a number of clockwise rotations 68 of mouthpiece 20. Clockwise rotation 68 of mouthpiece 20 causes helical blade 60 of auger 52 to rotate and move smoking material 8 from lower open end portion 14 and inner portion 18 toward upper open end portion 16. Repeated clockwise rotation 68 of mouthpiece 20 will cause substantially all of smoking material to be moved to the uppermost portion of housing 12 where it is ignited by a match, lighter, or other heat source. Mouthpiece 20 can be removed and smoking device 10 can be re-filled as previously described.

The foregoing description is intended for purposes of illustration. The invention may be embodied in other forms or carried out in other ways without departing from the spirit or scope of the invention.

What is claimed:

1. A device for consuming a smoking material comprising:

a glass housing comprising a lower open end portion, an upper open end portion, and an inner portion;

a mouthpiece comprising a rear body portion centrally disposed within said lower open end portion of said glass housing; said rear body portion comprises a read surface and first and second air passage ways extending inward from said rear surface;

a first rubber O-ring removably attached to said rear body portion; said rear body portion of said mouthpiece being rotatably and sealably engaged with said lower open end portion of said glass housing by said first rubber O-ring;

an auger comprising a first end portion engaged with said rear body portion of said mouthpiece and a second end portion extending within said inner portion of said housing to form a bowl area at said upper open end portion of said glass housing; said bowl area being bound by said upper open end portion of said glass housing and said second end portion of said auger; and rotation of said mouthpiece causes rotation of said auger causing the smoking material within said glass housing to move toward said bowl area.

2. The device of claim 1, wherein said mouthpiece comprises a second o-ring removably attached to said rear body portion to provide sealed engagement between said rear body portion and said lower open end portion of said glass housing.

3. The device of claim 2, wherein said auger comprises a helical blade.

4. The device of claim 3, further comprising a cap engaged with said upper open end portion of said housing.

5. The device of claim 4, wherein said cap is made from silicone rubber.

6. The device of claim 1, wherein said glass housing is a cylindrical tube.

7. The device of claim 1, wherein said auger is press-fitted with said rear body portion of said mouthpiece.

8. The device of claim 1, wherein said mouthpiece is made from brass.

* * * * *